US008191918B2

(12) United States Patent
Pupko

(10) Patent No.: US 8,191,918 B2
(45) **Date of Patent: *Jun. 5, 2012**

(54) DEVICE FOR ADJUSTING SKI BINDING HEIGHT FOR IMPROVED BALANCE

(76) Inventor: Michael M. Pupko, Colden, NY (US)

( * ) Notice: Subject to any disclaimer, the term of this patent is extended or adjusted under 35 U.S.C. 154(b) by 701 days.

This patent is subject to a terminal disclaimer.

(21) Appl. No.: 12/152,456

(22) Filed: May 14, 2008

(65) Prior Publication Data

US 2008/0290630 A1 Nov. 27, 2008

Related U.S. Application Data

(63) Continuation-in-part of application No. 10/530,859, filed as application No. PCT/US03/033107 on Oct. 17, 2003, now Pat. No. 7,387,309.

(60) Provisional application No. 60/419,186, filed on Oct. 17, 2002.

(51) Int. Cl.
*A63C 9/08* (2006.01)

(52) U.S. Cl. ..... 280/618; 280/607; 280/633

(58) Field of Classification Search ..... 280/605, 280/607, 11.14, 611, 614, 617, 618, 620, 280/623, 626, 631, 632, 633, 636
See application file for complete search history.

(56) References Cited

U.S. PATENT DOCUMENTS 3,675,938 A * 7/1972 Sigl ..... 280/636
4,002,354 A 1/1977 Ramer
4,007,946 A 2/1977 Sarver
4,083,576 A 4/1978 von Besser
4,085,947 A 4/1978 Sarver
4,094,529 A 6/1978 Nasson
4,135,335 A 1/1979 Jensen
4,135,736 A 1/1979 Druss
4,139,214 A 2/1979 Meyer
4,141,570 A * 2/1979 Sudmeier ..... 280/607
4,196,530 A 4/1980 Delery
4,288,093 A 9/1981 Krob et al.
4,353,575 A * 10/1982 Brice ..... 280/614
4,408,779 A 10/1983 Shekter
4,438,948 A 3/1984 Gertsch
4,586,727 A * 5/1986 Andrieu et al. ..... 280/607
4,674,766 A * 6/1987 Ramer ..... 280/614
4,718,694 A * 1/1988 Brice et al. ..... 280/605
4,725,069 A 2/1988 Stampacchia et al.

(Continued)

FOREIGN PATENT DOCUMENTS

DE 2064754 7/1972

*Primary Examiner* — John Walters
(74) *Attorney, Agent, or Firm* — James C. Simmons

(57) ABSTRACT

A mechanism for attaching a boot to a ski with the heel end of the boot being height adjustable. The toe end portion of the boot is pivotly attaching to the ski. A pair of members engaged to the heel end portion and the ski respectively engage each other in a manner to provide height adjustability of the heel end of the boot. A track on either of the boot or the ski is slidably engaged by the respective member. One of the members has an inclined serrated surface which engages a serrated surface of the other member for adjusting height. Alternatively, one of the members has an inclined surface, and height adjustment is achieved by a threaded rotatable member on one of the members which threadedly engages longitudinally spaced indents or other formations in the other member.

20 Claims, 10 Drawing Sheets

U.S. PATENT DOCUMENTS 5,116,073 A 5/1992 Goud
5,394,627 A 3/1995 Eugler
5,560,633 A 10/1996 McGowan
5,815,992 A * 10/1998 Wells et al. ..... 52/126.1
6,065,895 A 5/2000 Lehner et al.
6,648,362 B1 11/2003 Bunter
6,808,196 B2 10/2004 Des Ouches
7,387,309 B2 * 6/2008 Pupko ..... 280/617
2003/0155744 A1 8/2003 Gorza et al.

* cited by examiner

FIG. 5
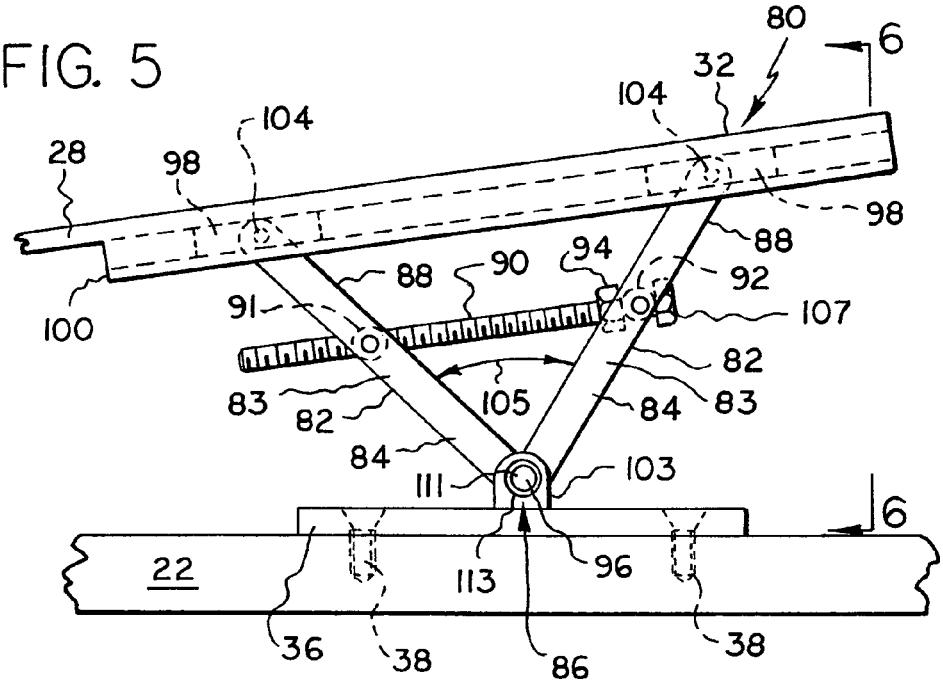
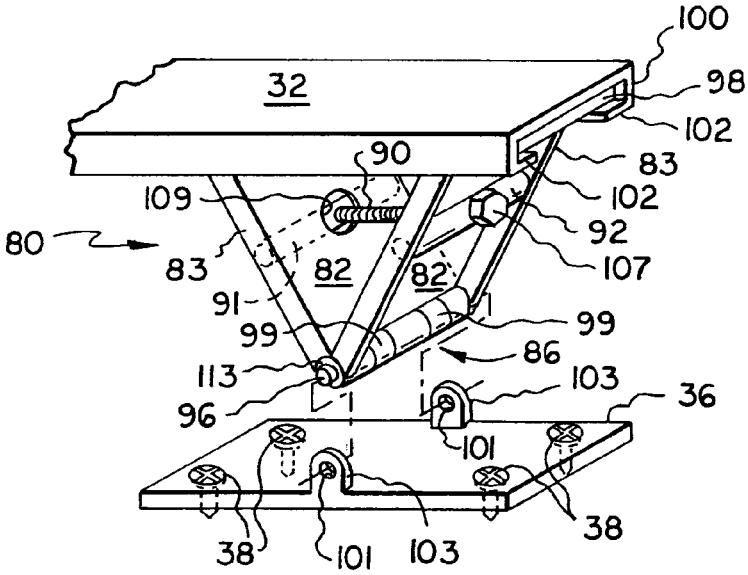
FIG. 6
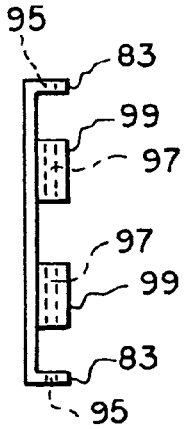
FIG. 6A

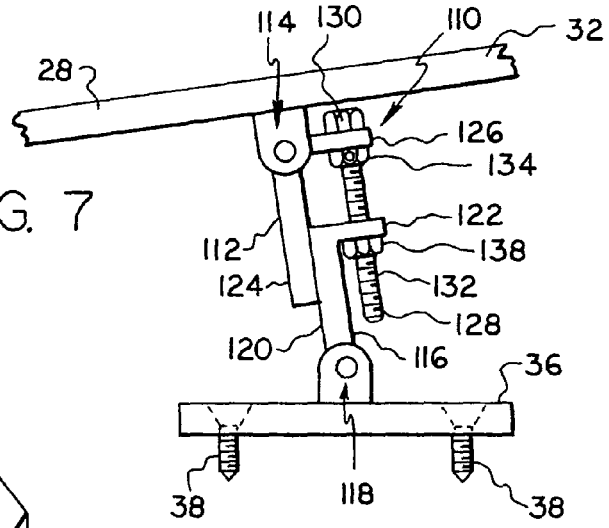
FIG. 7
FIG. 8
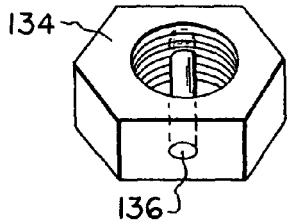
FIG. 9
PRIOR ART
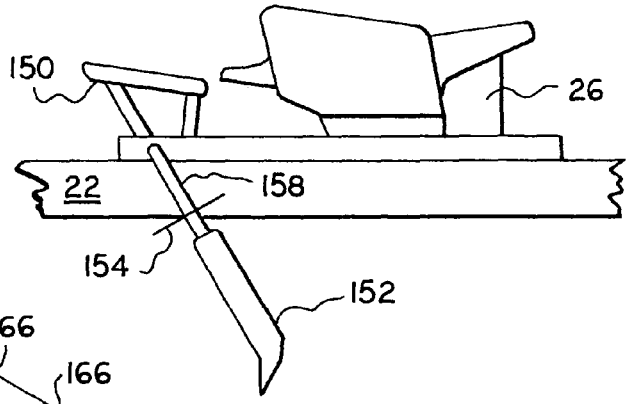
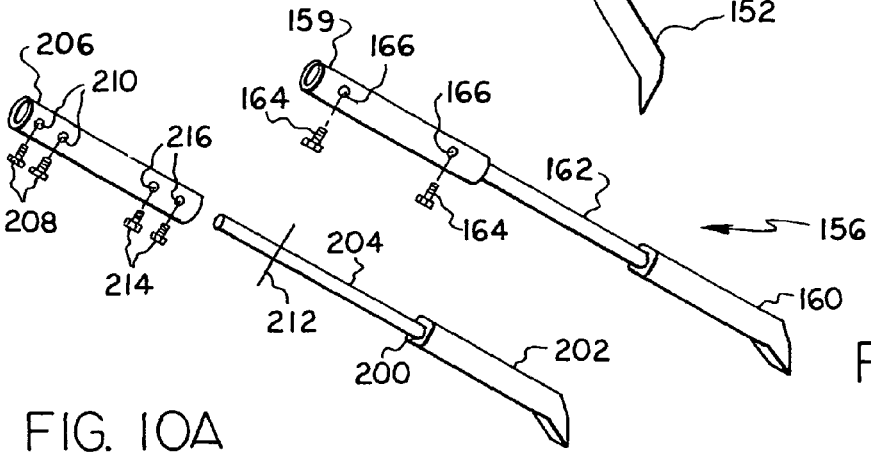
FIG. 10
FIG. 10A

DEVICE FOR ADJUSTING SKI BINDING HEIGHT FOR IMPROVED BALANCE

This is a continuation-in-part (and is also a divisional) of U.S. patent application Ser. No. 10/530,859, filed Apr. 8, 2005 now U.S. Pat. No. 7,387,309 (national stage of international application PCT/US2003/033107, filed Oct. 17, 2003), which claims priority of U.S. provisional patent application Ser. No. 60/419,186, filed Oct. 17, 2002, and such priority is hereby claimed. The disclosures of both of the above applications, as well as all patents/published applications disclosed herein, are hereby incorporated herein by reference.

The present invention relates generally to ski bindings, i.e., mechanisms for attaching boots to skis.

Skis and ski bindings have been provided wherein the bindings are adjustable along the lengths of the skis. One such adjustable binding is marketed by Marker Deutschland GmbH of Germany. These bindings include a rail attached to the ski along the length of which the binding is movable. The rail includes a series of longitudinally spaced recesses therein which are engaged by threads of a screw. The screw is turned to threadedly advance the binding for adjusting its position along the length of the ski. A similar system marketed by Skis Rossignol of France utilizes a series of longitudinally spaced nubs or bumps or raised portions instead of the recesses. A similar system marketed by Saloman Group of France utilizes a series of longitudinally spaced nubs or bumps or raised portions engagable by a spring-biased member that interlocks with the bumps at the desired binding position.

Typical ski equipment set-ups leave many people in very poor fore/aft positions, i.e., leaving many people inclined too far backward. This makes it difficult to balance with the result that it is harder to learn to ski, more tiring, and the risk of injury is increased. To achieve better balance, the skier's feet should often be inclined relative to the skis so that the heel is raised relative to the height of the toes. The correct fore and aft position will vary depending on the skier's body type. It is thus considered desirable for a skier to be able to adjust his or her fore and aft position (i.e., adjust the height of the heel end of the ski boot) to achieve the correct balance for him or her.

U.S. Pat. No. 4,007,946 to Sarver discloses in FIG. 8 thereof a ski having a height-adjustable heel device for elevating the heel of a skier's boot. The device has a pair of "scissors" members pivotly connected to the underside of a plate to which the boot attaches, and a screw mechanism connected to the ski spreads or contracts the members to lower or raise respectively the heel, the plate being pivotly mounted at the toe end thereof to the ski. Such a device may be "wobbly" and not provide the desired stability.

U.S. Pat. No. 4,135,736 to Druss, which is incorporated herein by reference, discloses a boot binding ski assembly having front and rear rests with the binding, illustrated at 82 in FIG. 12 thereof, positioned at the center. An adjustable heel comprising an adjusting mechanism is provided for elevational positioning. Druss discloses in FIGS. 10 and 11 thereof a variation of the rear rest vertical members with cooperating teeth, illustrated at 86 and 88 therein, and two screws received in height adjusting slots to provide height adjustment of the heel. This is for taking up play between the boot and ski and accordingly has a very limited height adjustment as well as not providing as much stability as may be desired.

U.S. Pat. No. 3,675,938 to Sigl discloses a ski with a boot platform which is inclinable by a pivot connection at its forward end and a mechanism for adjusting the height of the rear end. This height adjustment mechanism includes a stud to which a pin is welded, the pin being slideably received longitudinally in a recess, which is illustrated at 88 therein.

The reason for the recess is stated, at column 3, lines 35 to 37, thereof to be to accommodate longitudinal adjustment of the position of the platform member and boot. Such a mechanism is "wobbly" and does not provide the desired stability.

U.S. Pat. No. 4,141,570 to Sudmeier discloses height adjustable connections at all four corners of the plate to which the boot is attached. Such a height adjustment mechanism is also undesirably very complex and has many moving parts.

U.S. Pat. No. 4,586,727 discloses a supporting device comprising a pair of members having upper and lower inclined serrated surfaces respectively which height adjustably engage (by manually moving the lower member longitudinally), wherein the device is attached to a ski to serve as a support for the standarized smooth zone of the ski-boot sole in order to adapt ski bindings to the thickness of the ski-boot sole and limit parasitic friction forces and in order to prevent these friction forces from disturbing the operation of the ski binding. When the ski boot is placed in position in the ski-binding, the standarized smooth portion of the ski boot sole comes to rest on a slide plate of the upper member. Such a device does not provide for the desired height adjustment of the heel end relative to the toe end of the boot as contemplated by the present invention.

Additional art which may be of interest includes U.S. Pat. Nos. 4,002,354; 4,083,576; 4,085,947; 4,094,529; 4,135,335; 4,139,214; 4,196,530; 4,288,093; 4,353,575; 4,408,779; 4,438,948; 4,725,069; 5,116,073; 5,394,627; 5,560,633; 6,065,895; 6,648,362; 6,808,196; 2003/0155744, and German patent document DE 2,064,754. FIGS. 1 and 2 of this German reference show a boot bound to a plate whose forward end is pivoted or the like to a ski. A member on the ski has serrations which are engaged by a projecting member which emanates from the heel binding to adjust the height of the heel of the boot. In an alternative embodiment shown in FIGS. 3 and 4 of this German reference, the serrations are located on a member incorporated in the boot heel and the projecting member emanates from a vertical portion of the plate to which the boot is attached.

It is also important that the ski be able to flex as much as possible. The attachment of the adjusting screw mechanism of Sarver to the ski would undesirably inhibit flexion. The rigid plate, illustrated at 34 in FIG. 1 of Sigl, attached to the ski thereof would also undesirably inhibit flexion.

In order to improve ski flexion, bindings currently have been provided to be held in place on a ski at a single binding location (rather than both fore and aft binding locations) for movement in a track on the ski.

It is considered desirable to provide a stable and easy to use mechanism for making adjustment of a skier's fore and aft position much easier and in a large range to accommodate a maximum number of skiers regardless of body type. It is a goal to make the adjustment easy enough that most people could do it on their own on the slopes so that they can fine tune their positions to where they feel the most in balance.

It is accordingly a primary object of the present invention to provide an easy to use, uncomplicated and with a minimum of moving parts, stable, and reliable mechanism for adjusting the height of a skier's heel relative to the toes so that proper balance may be achieved by a maximum number of skiers regardless of body type.

It is a further object of the present invention to provide such an adjustment mechanism while eliminating or minimizing any reduction in ski flexion, thereby enhancing the ability of the ski to flex evenly.

In order to provide such an easy to use, stable, uncomplicated, reliable mechanism, in accordance with the present invention, the toe binding for a boot (by means of a plate attached thereto or otherwise) is pivotably attached to a ski, and the heel binding for the boot is attached to the ski by a pair of members attached to the heel binding (by means of the plate attached thereto or otherwise) and ski respectively and having serrations which interlockingly engage each other at various adjusted positions of one of the members relative to the other thereof, in a manner such that applied forces from the boot are generally normal to the surfaces for increased stability, for adjustment of the heel height, and at least one fastener is provided for connecting the members at various heights to which the heel is adjusted.

In order to provide such an easy to use, stable, uncomplicated, reliable mechanism, in accordance with the present invention, the toe binding for a boot (by means of a plate attached thereto or otherwise) is pivotably attached to a ski, and the heel binding for the boot is attached to the ski by a pair of members attached to the heel binding (by means of the plate attached thereto or otherwise) and ski respectively and having surfaces, at least one of which is inclined, which engage each other at various adjusted positions of one of the members relative to the other thereof for adjustment of the heel height.

In order to eliminate or minimize any reduction in ski flexion, in accordance with the present invention, the upper one of the members is slidably connected to the heel end portion of the plate (or otherwise the boot) and/or the lower member is slidably connected to the ski.

The above and other objects, features, and advantages of the present invention will be apparent in the following detailed description of the preferred embodiments thereof when read in conjunction with the appended drawings in which the same reference numerals depict the same or similar parts throughout the several views.

BRIEF DESCRIPTION OF THE DRAWINGS

FIG. 5 is a view similar to that of FIG. 1 of a ski binding in accordance with another alternative embodiment of the present invention.

FIG. 6 is a view thereof taken along lines 6-6 of FIG. 5.

FIG. 6A is a top view of one of a pair of brackets for the ski binding of FIG. 5.

FIG. 7 is a view similar to that of FIG. 1 of a ski binding in accordance with another alternative embodiment of the present invention.

FIG. 8 is a perspective view of a nut used in the binding of FIG. 7.

FIG. 9 is a schematic view showing a conventional ski brake for the ski.

FIG. 10 is a perspective view of an attachment to the ski brake for use when using the present invention.

FIG. 10A is a view similar to that of FIG. 10 of an alternative embodiment of the attachment.

DETAILED DESCRIPTION OF THE PREFERRED EMBODIMENTS

Figure 1:
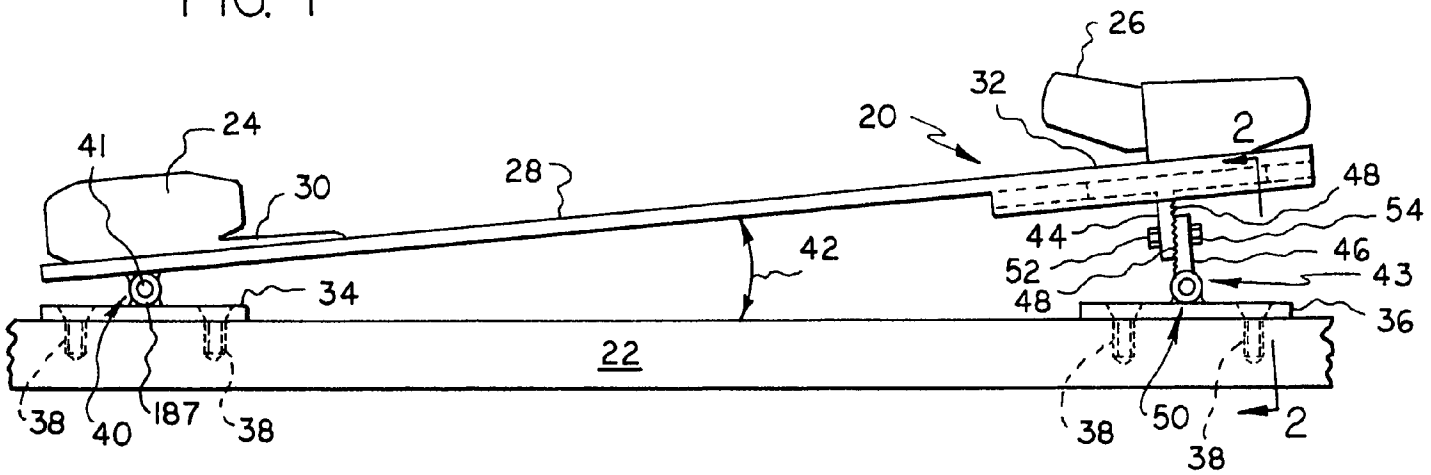
FIG. 1 is a side schematic view of a ski binding according to the present invention.
Figure 2:
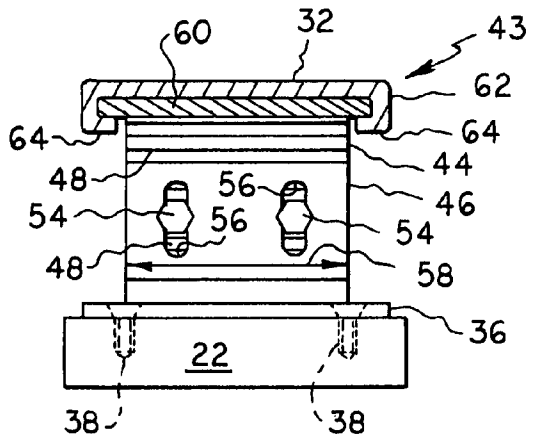
FIG. 2 is a view thereof taken along lines 2-2 of FIG. 1.

Referring to FIGS. 1 and 2, there is shown generally at 20 a mechanism for attaching a boot to a ski 22, the toe and heel binding being conventional and illustrated at 24 and 26 respectively and corresponding to the toe and heel portions respectively of a boot to be attached to the ski 22. It is of course to be understood that the attachment of a boot to a ski, in accordance with the present invention, is via the use conventionally of bindings, as discussed hereinafter.

The mechanism 20 includes an elongate plate 28 to which the bindings 24 and 26 are suitably and conventionally attached in accordance with principles commonly known to those of ordinary skill in the art to which the present invention pertains, the plate 28 having a toe end portion 30 to which the toe binding 24 is attached and a heel end portion 32 to which the heel binding 26 is attached. The plate 28 has a width and length equal generally to the width and length of the bindings for the boot to be bound thereto (which is generally equal to the width and length of the boot).

For purposes of providing a means for attachment of the elongate plate end portions 30 and 32 to the ski 22, as hereinafter discussed, corresponding plates 34 and 36 respectively are fixedly attached to the ski 22 such as by screws 38 or other suitable means. The width of each of the plates 34 and 36 is generally equal to the width of the elongate plate 28, and the length of each of the plates 34 may, for example, be generally equal to the width thereof, or otherwise as suitable. Each plate 34 and 36 may, for example, have 4 of the screws 38, one at each corner, or other suitable number of screws.

The toe end portion 30 is pivotly connected to the plate 34 by a conventional pivot or hinged connection, illustrated at 40, including a hinge pin 41, to allow the elongate plate 28 to be adjusted through the angle illustrated at 42 so that the height of the skier's heel relative to the skier's toes may be adjusted to achieve the optimum balance for the particular skier. The hinged connection 40 may, for example, be similar to the hinged connection illustrated in the aforesaid U.S. Pat. No. 4,353,575 and discussed at column 3, lines 1 to 5, thereof, which patent is hereby incorporated herein by reference. For another example, the hinged connection may be similar to a conventional door hinge, such as shown at 86 in FIGS. 5 and 6. In order to accommodate most skiers, the angle 42 is preferably adjustable up to at least about 10 degrees.

In order to provide an easy to use, stable, uncomplicated, reliable means for adjustment of the height of the heel end portion 32 relative to the toe end portion 30 through the angle 42, in accordance with the present invention, a height adjustment assembly, illustrated generally at 43, is provided wherein the heel end portion 32 is attached to the ski plate 36 by upper and lower members 44 and 46 respectively having complementary teeth or serrations, illustrated at 48, on facing sides for interlockingly engaging each other. The lower serrated member 46 is pivotly attached to ski plate 36 by a conventional pivot or hinged connection, illustrated at 50, which may be similar to hinged connection or otherwise as suitable. The upper serrated member 44 is attached to the elongate plate heel end portion 32 as hereinafter discussed. The members 44 and 46 are fixedly attached at an adjusted position by at least one but preferably a pair of bolts 52 and corresponding nuts 54 or other suitable fasteners, the shanks of the bolts 52 received in apertures (not shown) in member 44 and in vertically elongated adjustment slots, illustrated at 56, in the other member 46. It should be evident that the adjustment slots 56 may be provided in either of the members 44 and 46 and that the bolts 52 and nuts 54 may be interchanged. It should also be understood that either the bolt heads or the nuts may desirably be conventionally fixed to the respective member so as to be free from turning thereby making height adjustment easier for the skier. The width, illustrated at 58, of each of the members 44 and 46 is generally equal to the width of the elongate member 28 to thereby provide stability. Thus, it can be seen that the members may be attached by the bolts 52 and nuts 54 at any of various heights to which the heel portion 32 is to be desirably adjusted, with the serrations 48 on the upper member 44 bearingly and interlockingly engaging the complementary serrations 48 on the lower member 46 to stably provide the needed support. The serrations 48 are desirably sized, in accordance with principles commonly known to those of ordinary skill in the art to which the present invention pertains, to provide height adjustments of, for example, as little as ⅛ degree.

It is important that the ski 22 be able to flex as much as possible to make turning easier, and modern skies are typically constructed to maximize their flexing ability. During flexing of the ski, the distance between the plates 34 and 36 varies. In order to compensate for this variance in distance so that the ski 22 may be enabled to sufficiently flex as well as to evenly flex, the upper serrated member 44 is slidably attached to the heel portion 32 by an overhanging upper portion 60 of upper member 44 which is slidably received in a track, illustrated at 62, on the lower surface of heel portion 32. The track 62 comprises a pair of underhang portions 64 which are spaced apart a distance which is less than the width of the member overhanging portion 60 so that the portion 60 is retained slidably within the track 62. The track 62 may be open-ended at one or both ends to allow the member portion 60 to be inserted into the track 62 and is desirably long enough so that the member portion 60 does not come out of the track 62 during skiing.

In order to adjust the angle 42 so as to adjust the height of the skier's heel relative to the toes for improved balance as well as to achieve increased leverage, even while on the ski slopes, the skier may easily and quickly loosen the nuts 54, incrementally raise or lower the upper member 44 relative to the lower member 46, tighten the nuts 54 on the bolts 52 to firmly secure the members 44 and 46 in the newly adjusted position, and then go about enjoying skiing even more at the improved balance and leverage and with the upper member portion 60 sliding within the track 62 so that flexing of the ski for better turning is not unduly hampered.

It should be understood that the boot and ski plates 28, 34, and 36 are not essential to the present invention and that the toe binding 24 may be directly or otherwise pivotly connected to the ski 22 and the serrated members 44 and 46 directly or otherwise connected to the heel binding 26 and ski 22 respectively. The device of the present invention need not be a separate device but may instead be built into the ski and/or binding. Thus, a reference to the toe or heel end portion or to a ski in the claims is meant to also refer to plates attached or attachable thereto.

Figure 3:
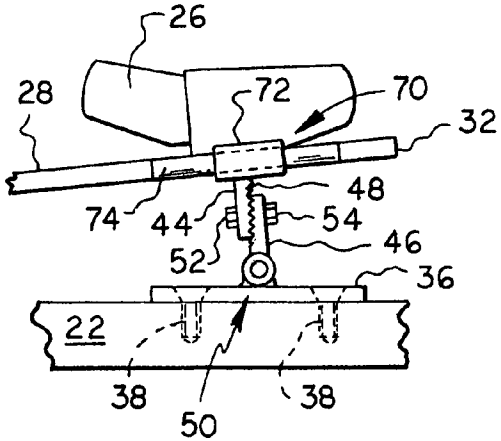
FIG. 3 is a partial view similar to that of FIG. 1 of a ski binding in accordance with an alternative embodiment of the present invention.
Figure 4:
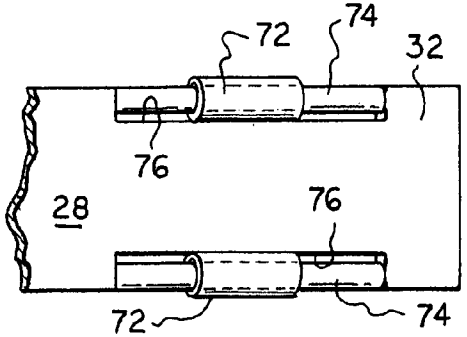
FIG. 4 is a partial perspective view of the boot plate thereof.

Referring to FIGS. 3 and 4, there is shown generally at 70 an alternative embodiment of the height adjustment assembly. The assembly 70, like the assembly 43 of FIGS. 1 and 2, comprises upper and lower serrated members 44 and 46 respectively attached by fasteners 52 and 54 and with the lower serrated member 46 pivotly mounted to the ski plate 36. In accordance with this alternative embodiment, the upper serrated member 44 is slidably attached to the heel end portion 32 of the boot plate 28 by a pair of tubular portions 72 suitably formed or otherwise attached on opposite sides respectively of the upper serrated member 44 and a pair of round rods 74 suitably formed or otherwise attached in cutouts 76 respectively on opposite sides respectively of the heel end portion 32 of the boot plate 28 and which are slidably received in the tubular portions 72 respectively.

Referring to FIGS. 5, 6, and 6A, there is shown generally at 80 an alternative embodiment of the height adjustment assembly. The assembly 80 comprises a pair of channel members 82 having side flanges 83 and the lower end portions 84 of which are pivotly attached to the ski plate by a suitable conventional pivot or hinge assembly 86, which is shown to be similar to a conventional door hinge. Thus, a hinge pin or pivot rod 96, providing a common pivot axis, is suitably received in apertures, illustrated at 95, in the side flanges 83 of each of the members 82 and in apertures, illustrated at 97, in alternate eyelet or tubular portions 99 on the bottom edges of the members 82, and at each end the hinge pin 96 is received in apertures, illustrated at 101, in eyelet members 103 which are welded or otherwise suitably attached to plate 36. The pin 96 is desirably (but not required to be) secured against removal from the hinge by suitable means such as, for example, a head 111 and washer 113 on one end and a nut (not shown) and washer (not shown) at the other end. Thus, the structural members 82 may be pivotly spread apart or contracted, as illustrated at 105 in FIG. 5, by pivotal movement on the hinge pin 96.

The upper end portions 88 of the members 82 are attached to the heel end portion 32 of plate 28, as hereinafter discussed. Intermediate the height of the members 82, elongate members 91 and 92 such as bars or tubular members are mounted to extend between the respective flanges 83 of the members 82 respectively and are suitably attached to the respective flanges 83 such as by screws (not shown) so that they can pivot (i.e., are rotatable about the longitudinal axis). The head end portion 107 of an adjustment bolt or screw 90 is received in an unthreaded aperture in member 92 and a nut 94, similar to nut 134 in FIG. 8, placed thereon so that the screw 90 rotates in place with the member 92 sandwiched between the bolt head and the nut 94. The screw 90 is threadedly received in a threaded aperture centrally located in rotatable member 91 to draw the members together or apart, as illustrated at 105) to increase or decrease respectively the distance between the plates 28 and 36 and thereby adjust the heel height, the members 91 and 92 being rotatable (pivotal) to allow alignment of the apertures therein during adjustment. Suitable openings, illustrated at 109 for one of the channel members, are provided in the channel members 82 for unfettered passage of the screw 90. The upper portion 88 of each of the members 82 is pivotably attached to an overhanging member 98 by means of a pin 104 or other suitable pivoting device. In order to allow the ski 22 to be able to sufficiently flex, these upper portions 88, similarly as shown in FIG. 2, are slidably attached to the heel portion 32 by the pivotly-connected overhanging members 98 being slidably received in a track, illustrated at 100, on the lower surface of heel portion 32. The track 100 comprises a pair of underhang or rail portions 102 which are spaced apart a distance which is less than the width of each of the overhanging members 98 so that the overhanging members 98 are retained slidably within the track 100. The track 100 may be open-ended at one or both ends to allow the members 98 to be inserted into the track 100 and is desirably long enough so that the members 98 do not come out of the track 100 during skiing.

The placement of an adjustment screw so that it is rigidly attached to the ski at the ski end of the "scissors" members, as in the aforesaid U.S. Pat. No. 4,007,946, detracts from the ability of the ski to flex as needed. Thus, in accordance with the present invention, the hinge 86 is instead placed at the ski plate 36. In order to provide increased stability, the "scissors" members 82 have a width which is generally equal to the width of each of plates 28 and 36.

The present invention is not limited to the particular components for the height adjustment assembly, which components are disclosed for exemplary purposes only. Thus, the present invention may be otherwise embodied for providing the desired height adjustment while allowing the ski to suitably flex. For example, the member 82 on the right side in FIGS. 5 and 6 may be removed, its corresponding elongate member 92 suitably mounted to the track 100 (or plate 32) so that it can pivot (i.e., rotate about its longitudinal axis), and elongate member 91 positioned to also serve as pin 104. This alternative assembly would thus allow pivoting at 104 and at the hinge 86 for height adjustment while also still allowing the ski to suitably flex.

Referring to FIGS. 7 and 8, there is shown generally at 110 an alternative embodiment of the height adjustment assembly. The assembly 110 comprises a member 112 pivotly mounted at pivot assembly 114 to the boot plate end portion 32 and another member 116 pivotly mounted at pivot assembly 118 to the ski plate 36. The pivot assemblies 114 and 118 may each be similar to hinge 50. Member 116 has a portion 120 which extends upwardly from hinge 116 to a point midway between the plates 28 and 36 and a portion 122 extends therefrom generally normal thereto. Member 112 is similarly shaped; a portion 124 terminates at a point midway between the plates 28 and 36 and has a track (not shown) on each side (similar to track 100 in FIGS. 5 and 6) in which is slidably received member 116 to act as a backing or support for member 116 to thereby provide increased stability, and another portion 126 extends from the hinge 114 and generally normal to portion 124. Thus, as seen in FIG. 7, the portions 122 and 126 are generally parallel to each other and spaced vertically so that by drawing them together or apart the heel height may be adjusted. Adjustment is provided by a pair of bolts or screws 128 (one on each side, only one shown) having a head 130 and the shank 132 of which is received in an aperture in portion 126 and a nut 134 applied thereto so that the portion 126 is disposed between the bolt head 130 and the nut 134. The nut 134, as seen in FIG. 8, has a roll pin 136 which passes centrally through the nut (normal to the nut axis) and is received in an aperture in the shank 132 whereby the bolt 128 cannot be moved axially but can be turned for providing height adjustment. The shank 132 is threadedly received in a threaded aperture in the portion 122. A locknut 138 is provided on the shank 132 to lockingly bear against the underside of the portion 122. Thus, by turning the bolt head 130, the vertical distance between the portions 122 and 126 may easily, even while on the ski slopes, be increased or decreased to adjust the heel height. Each of the members 112 and 116 has a width generally equal to that of plates 28 and 36 to provide good stability. Since it is envisioned that the assembly 110 may be difficult to mount as shown, it is believed that it may be more easily mounted at the rear edge of plate 28.

FIG. 9 shows a conventional ski brake 150 applied to the ski 22. When the heel height is adjusted as described herein, the ground engaging portion 152 of the brake 150 may be too high. In order to accommodate for the increased height, in accordance with the present invention, the portion 152 is cut off, as illustrated at 154, and an adaptive ground engaging portion, illustrated generally at 156 in FIG. 10, applied to the shank 158 of the brake 150. The adaptive portion 156 comprises a tubular portion 159 in which the shank 158 is received, a ground engaging portion 160, which is similar to the cut-off portion 152, and a shank portion 162 for increasing the overall shank length to thereby position the ground engaging portion 160 lower to compensate for the increased heel height. The tubular portion 159 is suitably attached to the shank portion 158 by a pair of axially spaced screws 164 received in apertures 166 in the tubular portion 159 and screwed into the shank portion 158 or by other suitable means. The length of the shank portion 162 may, for example, be about 2 inches.

Referring to FIG. 10A, in accordance with an alternative embodiment of the present invention, in order to provide for adjustment of the length of the shank portion 162 to allow more precise brake height adjustment, an adapter member 200 having a ground engaging portion 202 and a shank portion 204 is attached to the shank portion 158 by a separate tubular portion 206. The term "ground," as used herein and in the claims, is meant to include "snow." One end of the tubular portion 206 is slipped over the remaining shank portion 158 and attached thereto by a pair of axially spaced screws 208 received in apertures 210 respectively in the separate tubular portion 206 and screwed into the shank portion 158 or by other suitable means. The shank portion 204 is cut, as illustrated at 212, to achieve the desired brake length, and the remainder of the shank portion 204 is then received in the other end of the tubular portion 206 and attached thereto by another pair of axially spaced screws 214 received in apertures 216 respectively in the separate tubular portion 206 and screwed into the shank portion 204 or by other suitable means.

Figure 11:
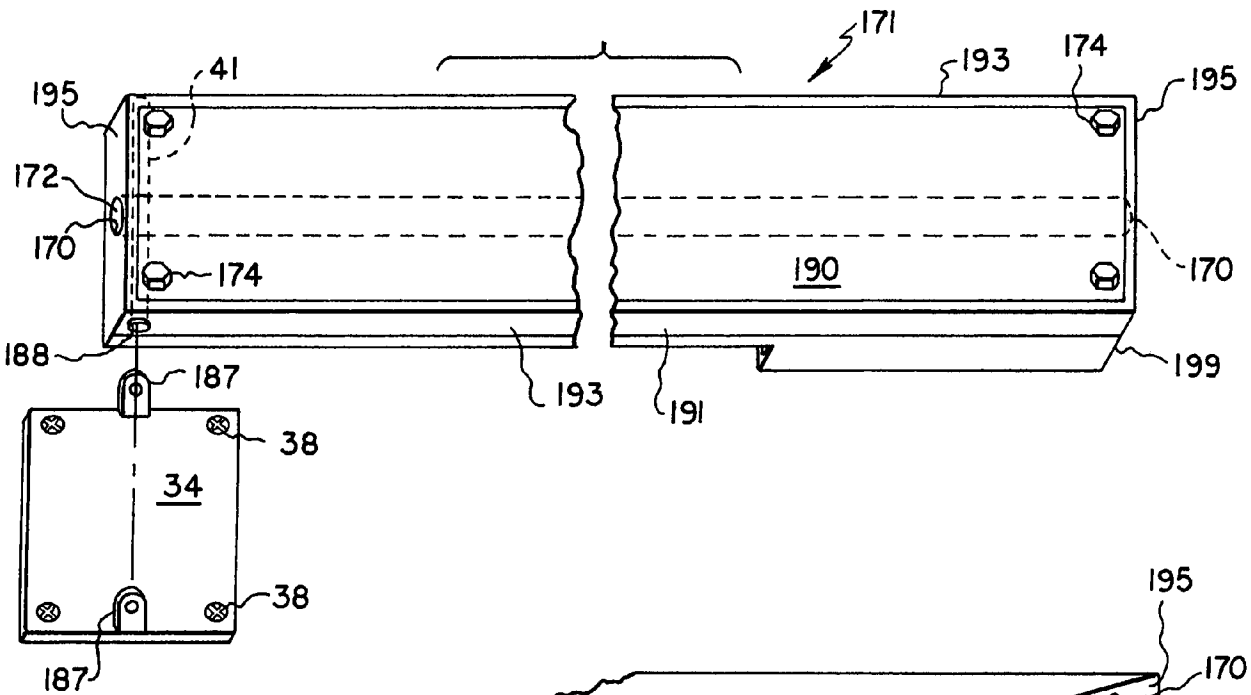
FIG. 11 is a perspective expanded view of a lateral adjustment mechanism which may be used with the present invention.
Figure 13:
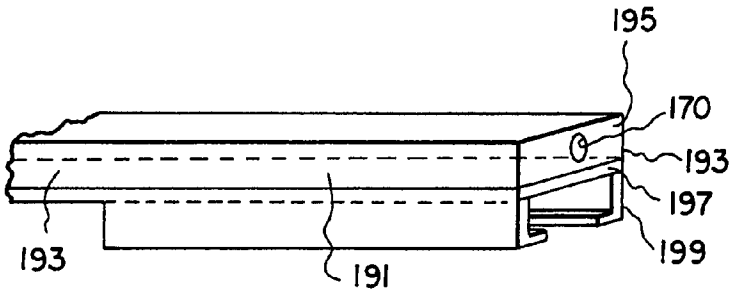
FIG. 13 is a perspective view of the other end portion of the adjustment mechanism.
Figure 12:
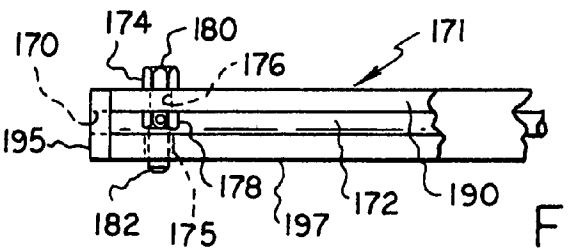
FIG. 12 is a side view, with a side wall of the housing removed, of an end portion of the adjustment mechanism.

Referring to FIGS. 11, 12, and 13, there is shown generally at 171 a lateral adjustment assembly for plate 190, which plate serves the same function (attachment of bindings) as plate 28 in FIG. 1. The lateral adjustment assembly 171 includes a housing 191 having side walls 193 joined by end walls 195 and a floor 197, the plate 190 being received over and spaced from the floor 197 and within the boundaries of the walls 193 and 195. For increased structural integrity, the floor 197 extends entirely over the length of the assembly 171, but it is not required that it do so. For example, floor portions may be provided at each end of the assembly 171 for purposes which will become apparent. An elongate rod 172 extends length-wise of the assembly 171 centrally of the width thereof, and the plate 190 rests thereon. The rod 172 is suitably fixedly received in and non-rotatably attached in a pair of apertures, illustrated at 170, in the end walls 195 respectively to allow the plate 190 to tilt laterally about the rod 172. Alternatively, the rod 172 may be mounted so as to be rotatable within the apertures 170, and the plate 190 may be attached fixedly to the rotatable rod. The lateral adjustment assembly 171 is provided to allow the plate 190 to be adjusted, for example, plus or minus about 3 degrees laterally to adjust the position laterally of the skier on the ski. A bolt or screw 174 is received in an unthreaded aperture 176 in each corner of the plate 190, and a nut 178 is screwed onto the bolt 174 so that the plate 190 is sandwiched between the bolt head 180 and the nut 178, and a roll pin (similarly as shown for roll pin 136 in FIG. 8) is inserted through the nut 178 and bolt shank 182 whereby the bolt 174 is prevented from vertical movement but can be turned to provide lateral adjustment. The bolt 174 is threadedly received in a threaded aperture, illustrated at 175, in the floor 197, whereby, by manipulation of the bolts 174 (i.e., by screwing inwardly on the bolts on one side of the plate 190 and by screwing outwardly a corresponding amount the bolts on the other side thereof), the lateral orientation of the plate 190 may be adjusted. The housing 191 is formed to have a track 199, similar to tracks 62 and 100, depending downwardly from the rear end portion thereof for rear height adjustment, and apertures 188 for receiving the pivot pin 41 (with the eyelet members 187 of plate 34 being disposed outwardly of the side walls 193 respectively) for pivotal movement of the assembly 171 at the forward end thereof.

Figure 15:
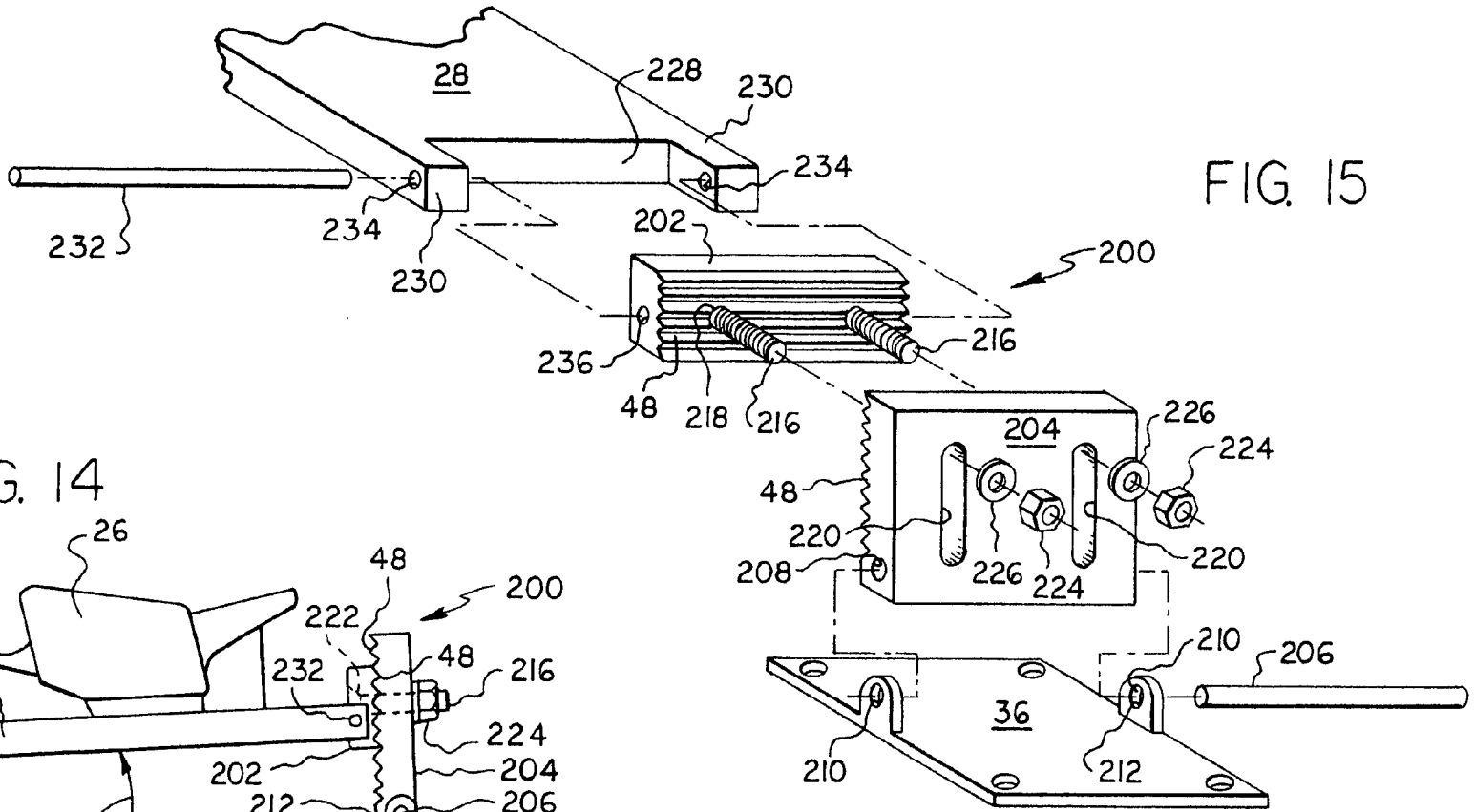
FIG. 15 is an exploded view of the height adjustment mechanism for the binding of FIG. 14.
Figure 14:
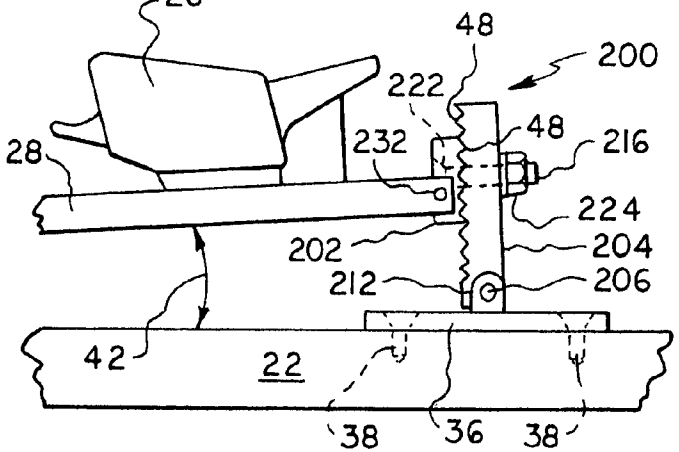
FIG. 14 is a partial view similar to that of FIG. 1 of a ski binding in accordance with another alternative embodiment of the present invention.

Referring to FIGS. 14 and 15, there is shown generally at 200 a height adjustment mechanism in accordance with an alternative embodiment of the present invention, the toe end portion having a hinged connection similar to that shown at 40 in FIG. 1. Height adjustment is provided by a pair of members 202 and 204 having the complementary teeth or serrations 48, similarly as shown for the assembly 43 of FIG. 1, on facing sides for interlockingly engaging each other. The member 202 is pivotly attached to the boot plate 28 as hereinafter described. The member 204 is pivotly attached to ski plate 36 by a hinged connection 50 similarly as shown for FIG. 1, including a hinge pin 206 which is received in an aperture, illustrated at 208, extending through a lower portion of the member 204 and through apertures, illustrated at 210, in eyelet members 212 protruding from opposite sides of the plate 36. Similarly as shown in FIG. 2, the members 202 and 204 are adjustably connected by a pair of screws 216 receivable in laterally spaced countersunk apertures, illustrated at 218, in member 202 and in laterally spaced vertically elongate apertures, illustrated at 220, in member 204, the head of one of the screws 216 illustrated at 222, and nuts and washers therefor illustrated at 224 and 226 respectively. Thus, the member 204 may be moved upwardly or downwardly relative to member 202 then fixed at an adjusted position by the interlocking serrations 48 engaging and by tightening of the nuts 224 on the screws 216 with the serrations interlocking with each other.

In accordance with a preferred embodiment of the present invention, in order to be able to adjust the angle 42 to a very small angle approaching zero degrees, the member 202 is pivotly attached to the rear end of the plate 28. Thus, the rear end of the plate 28 has a cut out, illustrated at 228, therein providing a pair of laterally spaced rearwardly extending protrusions 230. The member 202 is received in the cut out 228, and a pivot rod 232 is received in apertures, illustrated at 234, in the protrusions 230 and in an aperture, illustrated at 236, in the member 202. It should of course be understood that variations may be made in the assembly 200 as well as the other assemblies discussed herein. For example, instead of a single pin 232 or a single pin 206, a pair of short pins may be provided, each received on one side or the other of the respective member 202 and 204.

Figure 26:
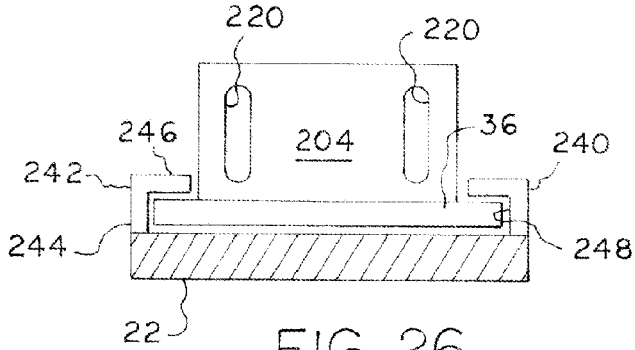
FIG. 26 is a partial sectional view of the ski binding of FIGS. 14 and 15 illustrating an alternative attachment to the ski.

Referring to FIG. 26, there is illustrated a ski 22 having a built-in track 240 extending over a portion of its length, it being understood that the track 240 could alternatively be a separate piece or pieces attached to the ski 22 and may be otherwise suitably shaped. The track 240 comprises a pair of laterally spaced portions 242 each having a vertical portion 244 and a portion 246 extending inwardly from the upper end of the vertical portion 244, thereby defining slots 248 in which the plate 36 is slidably received to allow suitable flexing of the ski 22 during skiing. As seen wherein an end of the track is shown, the track 240 is open-ended to allow the plate 36 to be inserted into the track 240 and is desirably long enough so that the plate 36 does not come out of the track 240 during skiing. In this embodiment the plate 36 is not pivotally connected to serrated member 204 but may be otherwise suitably attached thereto. It should be understood that the serrated plate 204 is otherwise attached to the plate 28 similarly as shown and discussed hereinbefore with respect to FIGS. 14 and 15. It should also be understood that it is within the scope of the present invention that other embodiments in this specification may also utilize tracks on the skis 22 instead of on or in connection with the heel binding in order to allow suitable flexing of the ski 22 during skiing.

Figure 16:
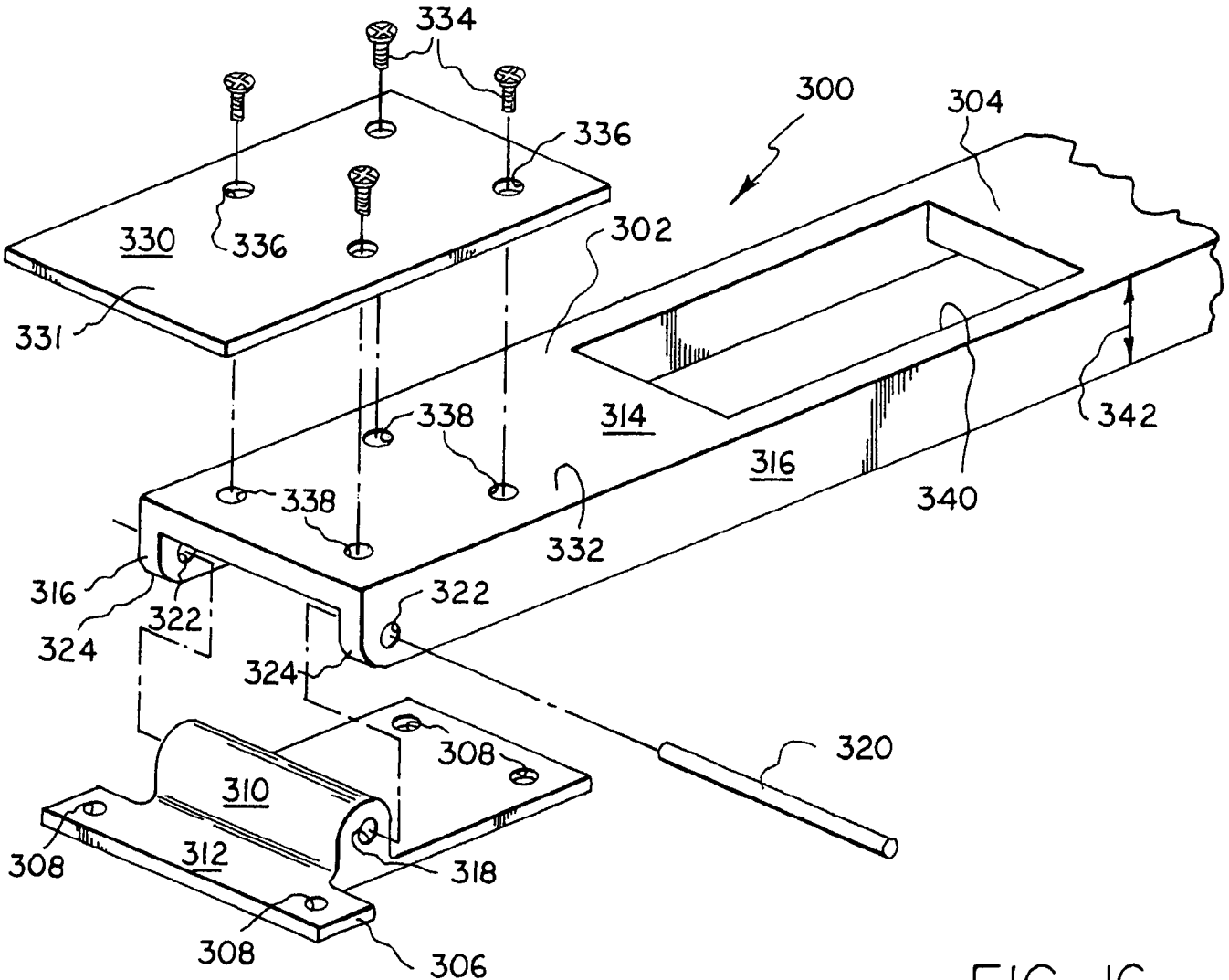
FIG. 16 is an exploded view of a binding attachment plate (partially shown) in accordance with another embodiment of the present invention, in combination with a toe end pivot structure.

Referring to FIG. 16, there is shown generally at 300 a plate to which toe and heel bindings 24 and 26 (not shown in FIG. 16) are attached and which is height adjustably attachable to a ski 22 as discussed hereinbefore. The plate 300 has a toe end portion 302 and a heel end portion 304 which are similar to the toe and heel end portions 30 and 32 respectively of FIG. 1. The plate 300 includes a generally flat portion 314 upon which the bindings are attached and a pair of flange portions 316 extending downwardly from the lateral edges of the flat portion 314. The toe end portion 302 is pivotly attached to a plate 306 which is in turn attached to the ski 22 by screws such as screws 38 in FIG. 1 received in apertures, illustrated at 308, in the plate 306 and threadedly received in apertures in the ski 22. The plate 306 is formed to have an upstanding tubular hinge portion 310, i.e., having a bore, illustrated at 318, extending laterally of the plates 300 and 306 therethrough. Forward of the hinge portion 310 is an increased width portion 312 of the plate 306, i.e., a portion which generally extends to the lateral edges of the ski 22. While shown to be integrally formed with the plate 306, it should be understood that the hinge portion 310 may be a separate member which is welded or otherwise suitably secured to the plate 306. In order to pivotly attach the forward end of the bindings or boot plate 300 to the ski plate 306, a hinge pin 320 is received in the bore 318 and in apertures, illustrated at 322 in the forward ends of the flange portions 316. The flange portions 316 have rounded lower forward end corners, illustrated at 324, in order to provide clearance with plate portion 312 during pivoting movement thereof. The plate 306 is of reduced width relative to the portion 312 thereof so as to be able to fit between the flange portions 316.

Race plates have been provided to raise the boots and bindings above the skis for greater leverage. In order to accommodate almost any size boot, these race plates are often made long, for example, 24 inches. Thus, if plate 300 were 24 inches long, it would accommodate the boots of all or almost all skiers. However, since the plate 300 must be of sufficient thickness to suitably accommodate forces acting thereon, such a length undesirably increases the weight thus undesirably increasing the burden of carrying the skis, especially for smaller people who have boot sizes which do not require such long plates. In order to reduce the carrying burden on smaller (as well as larger) persons while also accommodating larger boot sizes of larger persons, in accordance with the present invention, the bindings plate 300 is made to a relatively smaller length of, for example, 18 inches, and a decreased thickness extension 330 is attached to the top surface of flat plate portion 314 at the forward end portion 332 thereof to increase the length thereof by, for example, about 2 inches, to 20 inches overall. If desired, the extension may be provided to increase the length thereof by, for example, about 4 inches or longer, to 22 or more inches overall. The extension 330 is attached to the plate 300 by screws 334, for example, 4 no. 10-32 flat head screws, received in counterbored (to accommodate the flat heads) apertures, illustrated at 336, in the rearward end portion of the extension 330 and threadedly received in threaded apertures, illustrated at 338, in the forward end portion 332 of the flat plate portion 314. The forward end portion 331 of the lighter (less thickness) extension thus extends forwardly beyond the plate 300 to increase the overall plate length by as much as 2 or more inches.

Snow may tend to build up and cake between the plate 300 and the ski 22. This is a type of problem which used to be encountered under boots with the solution in recent years being that the soles of boots have been conventionally contoured to allow the escape of the snow. In order to allow snow to escape from between the plate 300 and the ski 22 as well as to reduce the carrying burden even more for both small and large people, a lightening cutout, illustrated at 340, is provided centrally of the length of the plate 300 (between the attachments of the bindings). While the cutout 340 is shown to be rectangular in shape, it should be understood that it may otherwise be suitably shaped or provided in other ways such as a series of apertures.

The following dimensions of the plate 300 and extension 330 as well as other dimensions and examples contained herein (unless the context clearly indicates otherwise) are for exemplary purposes only and not for purposes of limitation. The overall length and width of plate portion 314 may, for example, be about 18 inches and about 2¼ inches respectively. The flange portion height, illustrated at 342, may, for example, be about ½ inch. The thickness of each of the plate and flange portions 314 and 316 respectively may, for example, be about ¼ inch. The extension 330 may have a length, width, and thickness of about 4 inches, about 2¼ inches, and about 3;16 inch respectively and is attached to the plate 300 so as to extend, for example, about 2 inches forwardly thereof. The cutout 340 begins, for example, about 4½ inches from the forward edge of the plate 300, extends lengthwise of the plate 300 a distance of, for example, about 4 inches, and extends widthwise, for example, over the entire distance between the flange portions 316. The plates 300, 306, and 330 are made of aluminum or other suitable material.

It should be understood that, while tracks such as at 62 in FIG. 2 or 74 in FIG. 4 are shown on the boot plate (and of course may alternately be directly on the boot), they may alternatively be on the ski plate or directly on the ski.

It should be understood that, as used herein and in the claims, the term "serrations" is intended to include various teeth or saw-like notches or other suitable segments on one member which are formed to interlock with teeth or saw-like notches or other suitable segments on another member. For example, the serrations may have a staircase-like shape.

Figure 17:
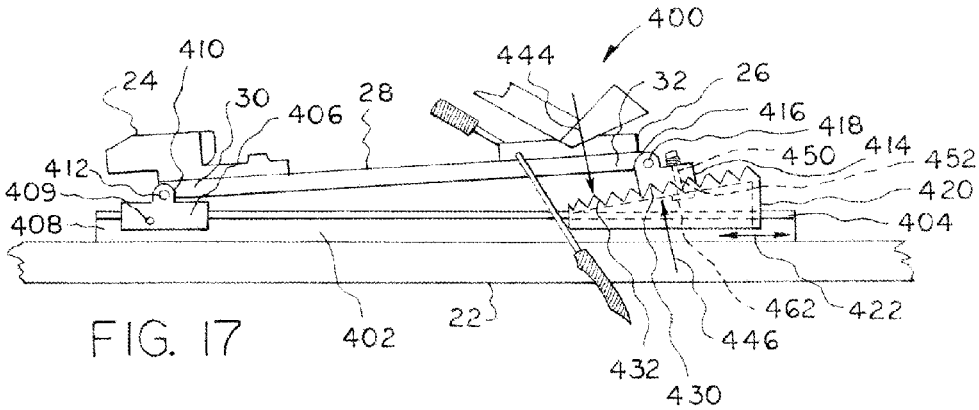
FIG. 17 is a view similar to that of FIG. 1 of a ski binding in accordance with another alternative embodiment of the present invention.
Figure 18:
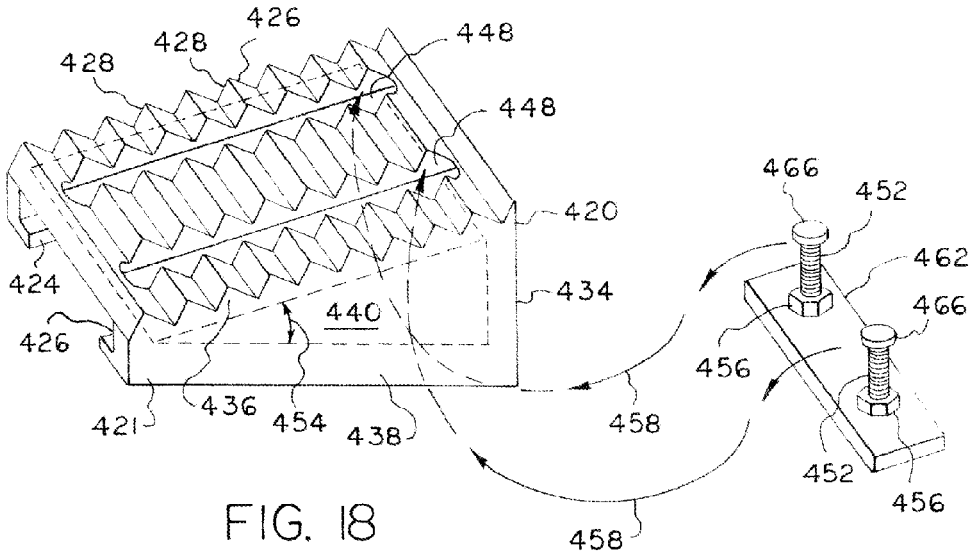
FIG. 18 is an enlarged detail perspective exploded view of the ski binding of FIG. 17 illustrating attachment of a heel adjustment block thereof to the ski.
Figure 19:
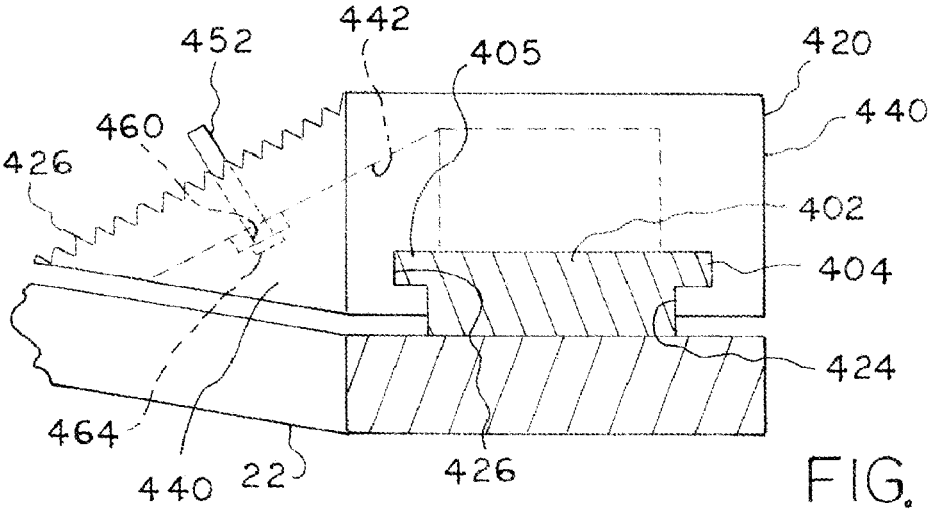
FIG. 19 is an enlarged detail perspective view of the block of FIG. 18 received on a rail attachable to a ski.

Referring to FIGS. 17 to 19, there is illustrated generally at 400 another alternative embodiment of the ski binding of the present invention. In order to allow the heel portion to slide relative to the ski 22 to enable sufficient and even ski flexion similarly as discussed with respect to the embodiment of FIGS. 1 to 4, an elongate track member 402 is suitably mounted on, such as by bolts or screws (not shown), or may alternatively be integral with or built into, the upper surface of the ski 22. The track 402 has an increased width upper portion or lip 404 defining a pair of elongate lateral protrusions or rails 405 extending generally over the length of the track member 402 (but need only extend enough over the track member length as needed for its purpose as described hereinafter). For example, the track 402 and ski 22 may be provided/sold pre-assembled (or integral) from a factory with the track 402 in a standard shape for receiving similarly standard-shaped toe and heel piece bindings 24 and 26 respectively to allow adjustment thereof longitudinally along the length of the ski 22, as is commonly known in the art. The track 402 is typically composed of molded plastic but may be composed of metal or other suitable material.

A suitable member 406, which may be composed of molded plastic or metal or other suitable material, is fixedly attached or locked in place, such as by one or more screws, bolts, pins, or other suitable fasteners or locking devices, illustrated at 409, to the toe end portion 408 of the track 402, but alternatively the member 406 may be formed integral with the track 402. The lower portion of the member 406 is suitably shaped so that it can be slid onto and along the track 402. The member 406 has a pair of laterally spaced upper ears 410 (one shown) between which the toe end portion 30 of the plate 28 (for receiving the bindings) is received and pivotly attached by a pin 412 suitably received in apertures in the end portion 30 (adjacent the end of the plate 28) and ears 410.

A block 414, which may be composed of molded plastic or metal or other suitable material, has a pair of laterally spaced upper forward ears 416 (one shown). The heel end portion 32 of the plate 28 is received between the ears 416 and pivotly attached to the block 414 by suitable means such as a pin 418 suitably received in apertures in the end portion 32 (adjacent the end of the plate 28) and ears 416.

A block 420, which may be composed of molded plastic, metal, or other suitable material, is formed to have a lower portion 421 suitably shaped to slide onto the rear end of and engage rail 402 for sliding of the block 420 longitudinally of the ski 22 along the rail 402, as illustrated at 422. Thus, the lower surface of the block 420 has a longitudinal recess, illustrated at 424 in FIG. 19, the inner portion 426 of which is widened to slidably receive the lateral rails 405. The block 420 has a surface 426 which has a series of serrations 428 which interlockingly engage complementary serrations 430 on a lower surface 432 of the member 414 for height adjustably attaching the heel binding 26 to the ski 22 as described in greater detail hereinafter.

Two vertically oriented members with interlocking serrations connecting a heel binding with a ski, such as shown in FIGS. 10 and 11 of the aforesaid U.S. Pat. No. 4,135,736, may be considered to not provide as much stability as may be desired. In order to distribute the pressure better on the serrated surfaces so as to provide improved stability, the block 420 is suitably formed so that the serrated surface 426 thereof is inclined. Thus, for example, as illustrated, it has a vertical rear wall 434, an inclined wall 436 extending from the upper edge of the rear wall 434 downwardly and forwardly to the forward edge of the bottom wall 438 in which the recess 424 is contained, and a pair of generally triangular side walls 440, leaving a generally hollow space, illustrated at 442, which will be discussed in greater detail hereinafter. As a result of the inclined surface 426, it can be seen in FIG. 17 that forces are applied in a direction generally perpendicular or normal to the inclined wall 436 of the block 420, as illustrated at 444, as well as generally perpendicular or normal to the block 414, as illustrated at 446, which can better withstand the applied forces from the boot (i.e., forces applied when one is standing normally in the boot on the ski and during normal skiing) than if the forces were applied in a direction generally parallel to the serrated surfaces to hereby achieve a more stable interlocking attachment. By "generally perpendicular" or "generally normal" of an applied force relative to a block surface or wall, as used herein and in the claims, is meant that the force vector or component of the applied force in a direction normal or perpendicular to the surface or wall is greater than the force vector or component of the applied force in a direction parallel to the surface or wall. Preferably, the applied forces from the boot are substantially normal or perpendicular (i.e., within about 10 degrees of being normal or perpendicular) to the block surface or wall. Preferably, the surface 426 or wall 436 is inclined at an angle, illustrated at 454, between about 1 and 50 degrees, for example, about 15 degrees. It may be as low as 1 degree because racers may already be well adjusted but may wish to fine tune their balance. The inclined surface 426 allows the height of the heel binding 26 to be adjusted by adjusting the position of the inclined block 420 relative to the block 414 by adjustable movement thereof longitudinally, as illustrated at 422, along the length of the track 402. As seen in FIG. 17, movement of the inclined block 420 forwardly (toward the toe end 408) causes a higher portion of the block 420 to engage the block 414 so that the height of the heel binding 26 is adjusted higher.

In order to lock the inclined block 420 at a desired heel binding height, the inclined wall 436 has a pair of longitudinally extending spaced parallel grooves, illustrated at 448, therein extending therethrough substantially over the length thereof. The block 414 has a pair of similarly spaced apertures, illustrated at 450, extending therethrough. Bolts 452 or other suitable fasteners are received in grooves 448 and apertures 450 respectively, as illustrated at 458, and nuts 456 applied and tightened to fix or lock the serrations 428 and 430 together to lock the inclined block 420 in the position for the desired heel binding height, illustrated at 458. The hollow space 442 is provided to allow the bolts 452 to be placed in position. Preferably, the bolts 452 (or studs) are threadedly received tightly in threaded spaced (equal to the spacing between grooves 448) apertures, illustrated at 460, in a suitable plate 462 and their heads 464 (or stud ends) may be welded to the plate 462. In order to adjust the position of the inclined block 420 for height adjustment, the nuts 456 are suitably loosened and the inclined block 420 moved along the track 402 to the desired new position, then the nuts 456 tightened at the new position. It is unnecessary that the nuts 456 be removed from the bolts 452 during such adjustment. However, a stop member 466 may be applied to the end of each bolt 452 to prevent the respective nut 456 from becoming inadvertently removed. The stop member 466 may, for example, be a nut or washer or a pin welded or otherwise suitably fixed thereto. It should of course be understood that the locking of the serrated surfaces in a desired position may be achieved by other suitable means such as, for example, by the use of a single slot 448 and/or by the use of another suitable fastening mechanism such as, for example, a cam locking device used with the slot or slots 448. For another example, the plate 462 may be dispensed with and the pair of bolts 452 may have heads large enough so as not to pass through the slots 448. For another example, the inclined block 420 may be formed not to have the hollow space but instead have a slot underneath the inclined wall 436 which allows movement of the plate 462 along the length of the inclined wall 436 (which might require the inclined block 420 to be composed of two pieces which are then welded or otherwise suitably attached together and the plate 462 and bolts 452 placed in position before such attachment). For another example, the inclined block 420 may be formed to have two or more narrow slots underneath the inclined wall 436 which allow movement of the heads of bolts (without a plate) along the length of the inclined wall 436.

As previously discussed, the pre-assembled rail and ski may come in different configurations. For example, referring to FIG. 20, there is illustrated generally at 500 a combination of a ski 502 with an inclined block 420, with a track 504 formed or built into the ski 502. Thus, the track 504 is formed by a longitudinal recess, illustrated at 506, in the ski 502, the inner or lower part 508 of the recess 506 being widened to provide a track. In order to conform the inclined block 420 to be complementarily received in the track 508, the lower part of the inclined block 420 is suitably formed to have a narrowed neck portion 510 terminating there below in a widened head portion 512 which is slidable received in the track 508. It should of course be understood that a pre-assembled ski/track or other track or ski with built-in track may have various track shapes, and the inclined block 420 is suitably constructed to accommodate whatever the shape of the track.

Figure 20:
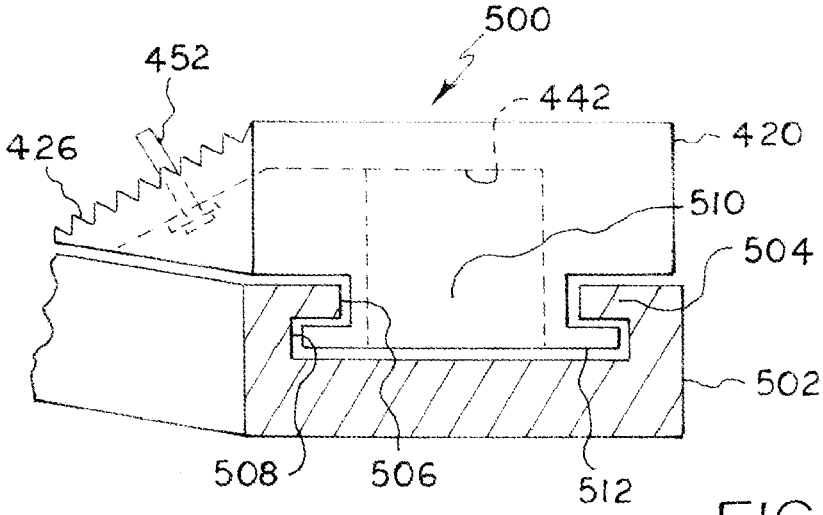
FIG. 20 is a view similar to that of FIG. 19 of an alternative embodiment of the ski binding of FIG. 17 wherein another embodiment of the block and rail is illustrated.

It should be understood that an inclined block may be moved along a track for height adjustment and held in an adjusted position by other means than interlocking serrations. Referring to FIGS. 21 to 24, there is illustrated generally at 600 structure attached to ski 22 and to the rear end of plate 28 (as an alternative to the blocks 414 and 420 in FIGS. 17 to 19). The structure 600 includes an inclined block 602 having a lower portion formed to slidably receive track 402, similarly as in FIG. 19, and it should be understood that the track may be otherwise suitably shaped such as shown in FIG. 20 and the block 602 suitably shaped to be complementary thereto for sliding along the track.

The inclined block 602, which may be composed of molded plastic, metal, or other suitable material, has a longitudinal (along the length of the ski 22) recess, illustrated at 604, in its upper surface, the recess 604 having an inner laterally increased width portion, illustrated at 606, which defines laterally spaced tracks 608 having inclined upper surfaces 610 on the laterally opposite sides. The inclined surfaces 610 extend downwardly from the rear or heel end toward the front or toe end. The bottom surface 612 of the recess 604 has a plurality of longitudinally spaced indents or notches or recesses, illustrated at 614, suitably formed therein generally laterally centrally thereof.

A block 616 has a generally cylindrical laterally extending portion 618 which is received in a cutout, illustrated at 620, between a pair of lateral end portions 622 of the plate 28 (the end portions 622 defined by the cutout 620). A pin 624 is suitably received in each of the apertures, illustrated at 626 (one shown), in the end portions 622 and in an aperture, illustrated at 628, extending axially through the entire width of the generally cylindrical portion 618, thereby pivotally connecting the block 616 to the ski binding plate 28.

Figure 21:
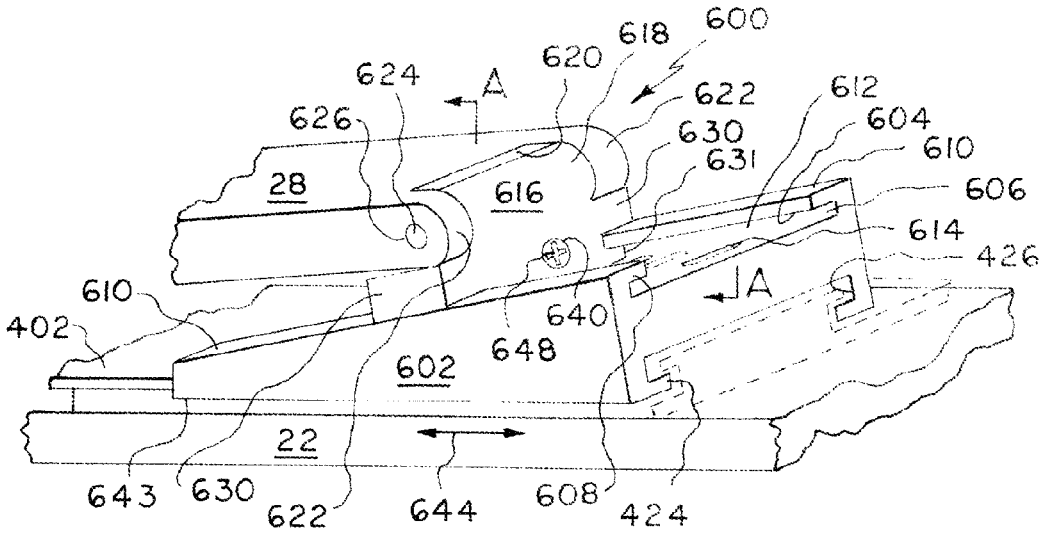
FIG. 21 is a partial view illustrating height adjustable attachment of binding to a ski in accordance with another embodiment.
Figure 22:
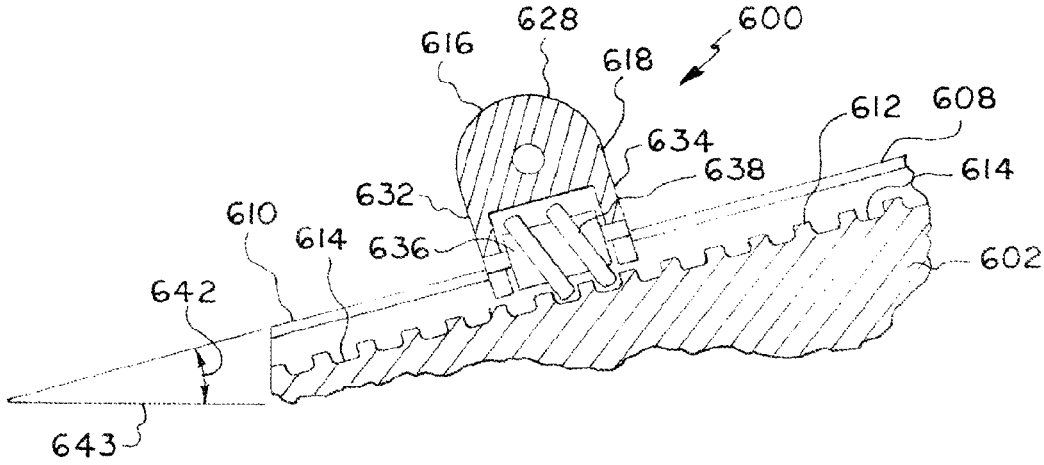
FIG. 22 is a partly sectional view, with portions removed for purposes of clarity, taken along lines A-A of FIG. 21.
Figure 23:
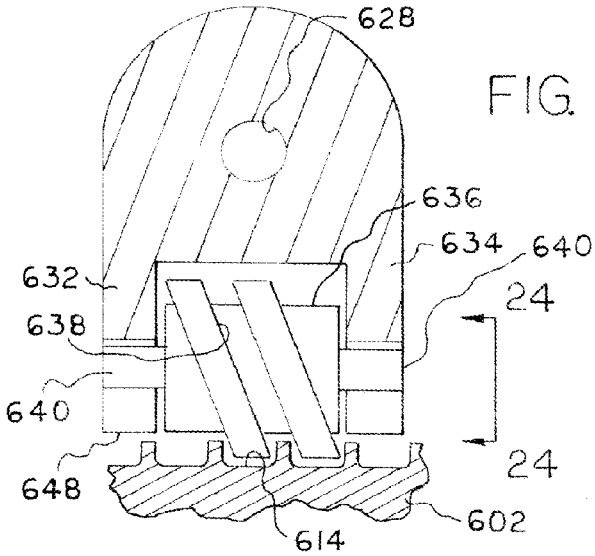
FIG. 23 is an enlarged detail view, partly sectional, of the upper block of the embodiment of FIG. 21, similarly as shown in FIG. 22.
Figure 24:
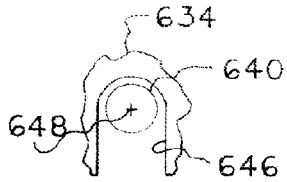
FIG. 24 is a partial view taken along lines 24-24 of FIG. 23.

The block 616, which may be composed of molded plastic, metal, or other suitable material, is formed to have a pair of upper portions 630 which are laterally projecting so as to be positioned to ride on the inclined surfaces 610 respectively and a pair of lower portions 631 (one shown) which are also laterally projecting so as to be positioned to fit within the increased width portion 606 and underneath the tracks 608 respectively so that the block 616 is lockingly but slidingly received on the tracks 608. The block 616 is further formed to have front and rear laterally centrally disposed walls 632 and 634 respectively (FIGS. 22 and 23) extending downwardly from the generally cylindrical portion 618 and between which is suitably centrally mounted to turn in place a screw 636 having enlarged threads 638. For example, FIGS. 22 and 23 show the thread 638 (i.e., two thread portions whose spacing is the same as the spacing of the notches 614) engaging two of the notches 614. The screw 636 terminates at its ends in a pair respectively of reduced diameter axle portions 640 which are rotatably received in vertical slots, illustrated at 646, in the walls 632 and 634 respectively, the slots 646 being recessed into the bottom surfaces 648 thereof, as best seen in FIG. 24. The axle portions 640 are held in place (i.e., without falling downwardly in or out of the slots 646) when the blocks 602 and 616 are assembled with the relative position of the block 616 fixed since it engages the tracks 608. The blocks 602 and 616 are assembled by holding the screw 636 in the slots 646 and, engaging the block 616 on the tracks 608 from the end thereof while at the same time effecting engagement of the screw thread 638 with the first of the indents 614 and continuing to turn the screw 636 to advance the block 616 further onto the tracks 608. As the screw 636 is turned (such as by a screwdriver received in slot 648 in the end surface of an axle portion 640), the thread 638 continues to successively engage notches 614 thus effecting movement of the inclined block 602 longitudinally. Preferably, the surface 610 is inclined at an angle, illustrated at 642 (which is the same as previously discussed for the angle 454), relative to the lower surface 643 of the block 602. The inclined surface 610 allows the height of the heel binding 26 to be adjusted by adjusting the position of the inclined block 602 relative to the block 616 by adjustable movement thereof longitudinally, as illustrated at 644, along the length of the tracks 608. As seen in FIG. 21, movement of the inclined block 602 forwardly (toward the toe end 408) causes a higher portion of the block 602 to engage the block 616 so that the height of the heel binding 26 is adjusted higher.

Figure 25:
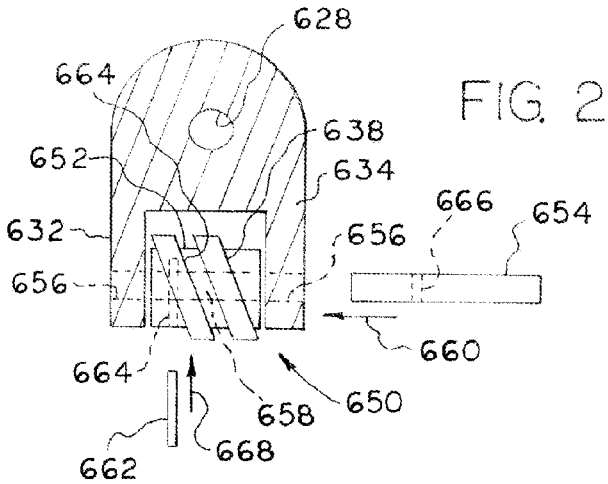
FIG. 25 is a view similar to that of FIG. 23 of an alternative embodiment thereof.

The screw 636 may be otherwise suitably embodied. For example, referring to FIG. 25, there is shown a screw 650 comprising a rotatable cylindrical body 652 which has thread 638. The body 652 is disposed between and connected to the walls 632 and 634 by a cylindrical axle 654 which is rotatably received in apertures, illustrated at 656, in the walls 632 and 634 and in a bore, illustrated at 658, which extends axially through the screw 650, as illustrated at 660. The axle 654 is fixedly connected to the screw 636 by a pin 662 which is suitably received in aligned radially extending apertures, illustrated at 664, in the screw body 652 and in a radially extending aperture, illustrated at 666, in the axle 654, as illustrated at 668, or otherwise suitably connected.

It should be understood that it is within the scope of the present invention that other suitable means may be provided for advancing block 616 or other suitable block along the inclined surface of block 602 or other suitable block. For example, the indents 614 may instead be raised bumps or projections, with the screw thread engaging between the bumps for advancing the block 616 along the inclined surface of block 602.

It should be understood that it is within the scope of the present invention that either of the blocks 414 or 616 be attached directly to heel binding rather than the plate 28. Thus, a recitation herein or in the claims that a member engages or is attached to a boot or a heel or toe portion thereof or to a ski is intended to mean that it is engaged or attached directly thereto or to a plate or track or other member which is attached thereto. Likewise, a recitation that a member engages such a plate or track or other member is intended to include that it is engaged or attached to the boot or a heel or toe portion thereof or to the ski.

It should be understood that, while the present invention has been described in detail herein, the invention can be embodied otherwise without departing from the principles thereof, and such other embodiments are meant to come within the scope of the present invention as defined by the appended claims.

What is claimed is:

1. A mechanism for attaching a boot to a ski, the mechanism comprising structure for pivotally attaching a toe end portion of the boot to the ski and structure for height adjustably attaching a heel end portion of the boot to the ski, said height adjusting structure comprising first and second members engaged to the heel end portion and the ski respectively and having surfaces respectively for adjustably engaging each other at various heights of the heel end portion in a manner such that applied forces from the boot are generally normal to said surfaces, each of said members having a plurality of serrations in said respective surface for engaging complementary ones of said serrations in said surface of an other of said members at various heights of the heel end portion, and at least one fastener for connecting said members at various heights of the heel end portion.

2. A mechanism according to claim 1 wherein said second member is shaped to slidingly engage a track on the ski.

3. A mechanism according to claim 1 wherein said first and second member surfaces engage each other in a manner such that applied forces from the boot are substantially normal to said first and second member surfaces.

4. A mechanism according to claim 1 wherein said first member is pivotally attached to said heel end portion.

5. A mechanism according to claim 1 wherein said surface of one of said first and second members is inclined.

6. A mechanism according to claim 5 wherein said one member has an inclined wall which defines said inclined surface, said wall having at least one longitudinal slot therein for receiving said fastener.

7. A mechanism according to claim 1 wherein said second member has an inclined wall, said wall having at least one longitudinal slot therein for receiving said fastener.

8. A mechanism for attaching a boot to a ski, the mechanism comprising structure for pivotally attaching a toe end portion of the boot to the ski and structure for height adjustably attaching a heel end portion of the boot to the ski, said height adjusting structure comprising first and second members engaged to the heel end portion and the ski respectively, one of said first and second members having at least one inclined surface, and an other of said first and second members having a surface which engages said inclined surface whereby to adjust the height of the heel end portion, and the mechanism further comprising at least one fastener for connecting said members at the adjusted height of the heel end portion, wherein each of said members has a plurality of serrations in said respective surface for engaging complementary ones of said serrations in said surface of an other of said members at various heights of the heel end portion.

9. A mechanism for attaching a boot to a ski, the mechanism comprising structure for pivotally attaching a toe end portion of the boot to the ski and structure for height adjustably attaching a heel end portion of the boot to the ski, said height adjusting structure comprising first and second members engaged to the heel end portion and the ski respectively, one of said first and second members having at least one inclined surface, and an other of said first and second members having a surface which engages said inclined surface whereby to adjust the height of the heel end portion, and the mechanism further comprising at least one fastener for connecting said members at the adjusted height of the heel end portion, the mechanism further comprising means for threadedly moving said other member upwardly and downwardly along said inclined surface for adjusting the height of the heel end portion.

10. A mechanism according to claim 9 wherein said threadedly moving means comprises a plurality of longitudinally spaced indents in one of said first and second members and a member rotatably attached to an other of said first and second members and having threads which threadedly engage ones of said plurality of longitudinally spaced indents.

11. A mechanism for attaching a boot to a ski, the mechanism comprising structure for pivotally attaching a toe end portion of the boot to the ski and structure for height adjustably attaching a heel end portion of the boot to the ski, said height adjusting structure comprising first and second members engaged to the heel end portion and the ski respectively, one of said first and second members having at least one inclined surface, an other of said first and second members having a surface which engages said inclined surface, means for effecting relative incremental movements between said first and second members in a direction of incline along said inclined surface to thereby adjust the height incrementally of the heel end portion, and the mechanism further comprising at least one fastener for connecting said members at the incrementally adjusted height of the heel end portion, whereby to retain said first and second members at an adjusted incremental height during skiing.

12. A mechanism according to claim 11 wherein said inclined surface is inclined at an angle which is between about 1 and 50 degrees.

13. A mechanism according to claim 11 wherein said second member is shaped to slidingly engage a track on the ski.

14. A mechanism according to claim 11 wherein said first member is pivotally attached to said heel end portion.

15. A mechanism for attaching a boot to a ski, the mechanism comprising structure for pivotally attaching a first end portion of the boot to the ski and structure for height adjustably attaching a second end portion of the boot to the ski, said height adjusting structure comprising first and second members engaged to the second end portion and the ski respectively and having surfaces respectively for adjustably engaging each other at various heights of the second end portion in a manner such that applied forces from the boot are generally normal to said surfaces, each of said members having a plurality of serrations in said respective surface for engaging complementary ones of said serrations in said surface of an other of said members at various heights of the second end portion, and at least one fastener for connecting said members at various heights of the second end portion.

16. A mechanism according to claim 15 further comprising in combination therewith a replacement ground engaging brake portion for attachment to a shank of a ski brake after a ground engaging brake portion thereof has been cut off for providing a brake length commensurate with a different heel end portion height to which the heel end portion is adjusted, the mechanism further comprising a plate to which the boot is attachable, and an extension member attachable to an end portion of said plate for increasing said plate length.

17. A mechanism according to claim 15 wherein said second member is shaped to slidingly engage a track on the ski.

18. A mechanism for attaching a boot to a ski, the mechanism comprising structure for pivotally attaching a first end portion of the boot to the ski and structure for height adjustably attaching a second end portion of the boot to the ski, said height adjusting structure comprising first and second members engaged to the second end portion and the ski respectively, one of said first and second members having at least one inclined surface, and an other of said first and second members having a surface which engages said inclined surface whereby to adjust the height of the second end portion, the mechanism further comprising means for threadedly moving said other member upwardly and downwardly along said inclined surface for adjusting the height of the second end portion, and wherein said threadedly moving means comprises a plurality of longitudinally spaced indents in one of said first and second members and a member rotatably attached to an other of said first and second members and having threads which threadedly engage ones of said plurality of longitudinally spaced indents.

19. A mechanism according to claim 18 wherein said second member has an inclined wall, said wall having at least one longitudinal slot therein for receiving said fastener.

20. A mechanism according to claim 18 wherein said first member is pivotally attached to said heel end portion.

* * * * *